US008143776B2

(12) United States Patent
Toyoguchi

(10) Patent No.: US 8,143,776 B2
(45) Date of Patent: Mar. 27, 2012

(54) LUMINESCENT SCREEN AND IMAGE DISPLAY APPARATUS

(75) Inventor: Ginjirou Toyoguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 12/850,366

(22) Filed: Aug. 4, 2010

(65) Prior Publication Data

US 2011/0018428 A1 Jan. 27, 2011

Related U.S. Application Data

(63) Continuation of application No. PCT/JP2009/063258, filed on Jul. 24, 2009.

(51) Int. Cl.
*H01J 1/62* (2006.01)
*H01J 63/04* (2006.01)

(52) U.S. Cl. ..... 313/496; 313/495; 313/309; 313/310; 313/346 R

(58) Field of Classification Search ..... 313/495–497, 313/309–311, 336, 351, 346 R
See application file for complete search history.

(56) References Cited

U.S. PATENT DOCUMENTS

2003/0164675 A1* 9/2003 Ando ..... 313/495
2005/0082963 A1* 4/2005 Miyazaki et al. ..... 313/493
2006/0267477 A1* 11/2006 Hirasawa et al. ..... 313/495
2007/0126339 A1 6/2007 Kato et al.
2008/0048551 A1* 2/2008 Kijima et al. ..... 313/495
2009/0315445 A1* 12/2009 Chi ..... 313/311

FOREIGN PATENT DOCUMENTS

| | | |
|---|---|---|
| JP | 2000-243277 | 9/2000 |
| JP | 2002-319358 | 10/2002 |
| JP | 2003-317635 | 11/2003 |
| JP | 2004-079285 | 3/2004 |
| JP | 2004-095352 | 3/2004 |
| JP | 2006-004670 | 1/2006 |
| JP | 2006-202589 | 8/2006 |
| JP | 2007-005232 | 1/2007 |

* cited by examiner

*Primary Examiner* — Joseph L Williams
*Assistant Examiner* — Kevin Quarterman
(74) *Attorney, Agent, or Firm* — Canon USA Inc IP Division

(57) ABSTRACT

An image display apparatus includes a rear plate including an electron-emitting device; and a luminescent screen including a plurality of light-emitting members, a plurality of anode electrodes positioned so as to overlap the light-emitting members, a partition wall member positioned between the light-emitting members adjacent to each other, a stripe-shaped resistance member electrically connecting the anode electrodes adjacent to each other and being positioned on the partition wall member, and a feeding electrode electrically connecting the resistance member to a power supply, wherein the feeding electrode is, on a mesh-shaped base adjacent to the partition wall member, in contact with the resistance member and a terminal of the power supply circuit.

6 Claims, 10 Drawing Sheets

LUMINESCENT SCREEN AND IMAGE DISPLAY APPARATUS

CROSS-REFERENCE TO RELATED APPLICATIONS

This application is a Continuation of International Application No. PCT/JP2009/063258, filed Jul. 24, 2009, which is hereby incorporated by reference herein in its entirety.

BACKGROUND OF THE INVENTION

1. Field of the Invention

The present invention relates to a luminescent screen including light-emitting members and an image display apparatus including such a luminescent screen.

2. Description of the Related Art

In a display apparatus that displays images by irradiating light-emitting members with electrons emitted from electron-emitting devices, to increase brightness, the light-emitting members are desirably irradiated with electrons that have been sufficiently accelerated. For this reason, a high voltage needs to be applied to anodes. However, because of the size reduction in the thickness of display apparatuses in recent years, there are cases where discharging occurs between electron-emitting devices on a rear plate and anode electrodes on a face plate (luminescent substrate).

Patent Literature 1 discloses an anode panel having a configuration in which an assembly of anode electrode units (the anode electrode units are arranged in two-dimensional matrix) is electrically connected through a resistive material layer for the purpose of suppressing damage caused by discharging. Furthermore, Patent Literature 1 also discloses that a grid-shaped partition wall is provided so as to surround a fluorescent material for the purpose of suppressing optical cross talk.

However, the structure of Patent Literature 1 needs to be improved in that the potential of anodes is stabilized.

An object of the present invention is to provide a luminescent screen and an image display apparatus including such a luminescent screen that overcome the above-described problem.

SUMMARY OF INVENTION

To overcome the above-described problem, the present invention provides an image display apparatus including a rear plate including an electron-emitting device; and a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the feeding electrode is, on a mesh-shaped base adjacent to the partition wall member, in contact with the resistance member and a terminal of the power supply circuit.

The present invention also provides an image display apparatus including a rear plate including an electron-emitting device; and a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the partition wall member includes a mesh-shaped portion positioned outside a region where the plurality of light-emitting members are positioned on the substrate; and the feeding electrode is, on the mesh-shaped portion of the partition wall member, in contact with the resistance member and a terminal of the power supply circuit.

The present invention also provides a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the feeding electrode is, on a mesh-shaped base adjacent to the partition wall member, in contact with the resistance member and includes a connection part on the mesh-shaped base, the connection part being connected to a terminal of the power supply circuit.

The present invention also provides a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the partition wall member includes a mesh-shaped portion positioned outside a region where the plurality of light-emitting members are positioned on the substrate; and the feeding electrode is, on the mesh-shaped portion of the partition wall member, in contact with the resistance member and includes a connection part on the mesh-shaped portion, the connection part being connected to a terminal of the power supply circuit.

Further features of the present invention will become apparent from the following description of exemplary embodiments with reference to the attached drawings.

DESCRIPTION OF EMBODIMENTS

Figure 1:
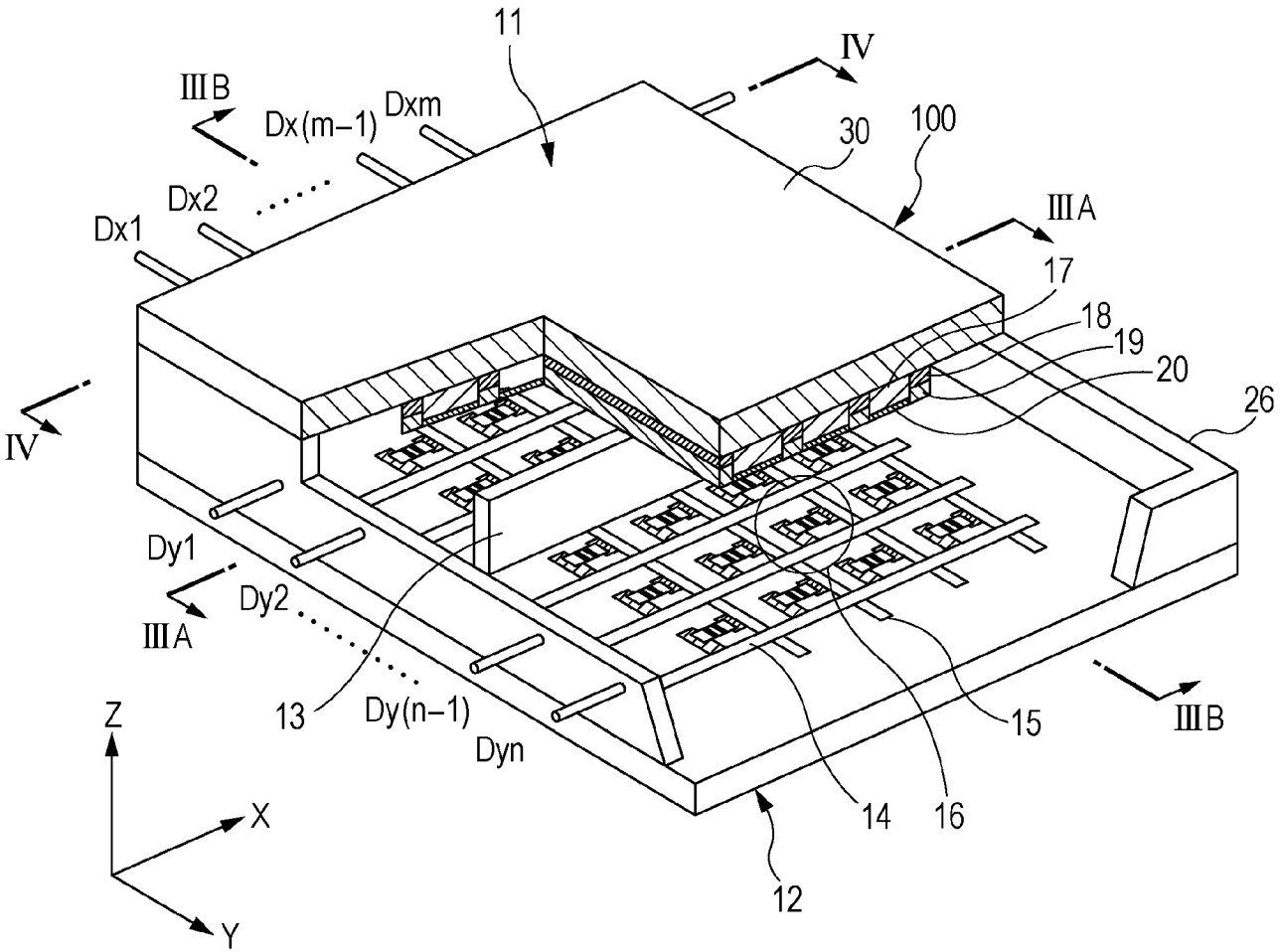
FIG. 1 is a cutaway perspective view illustrating the general configuration of an image display apparatus according to the present invention.
Figure 2A:
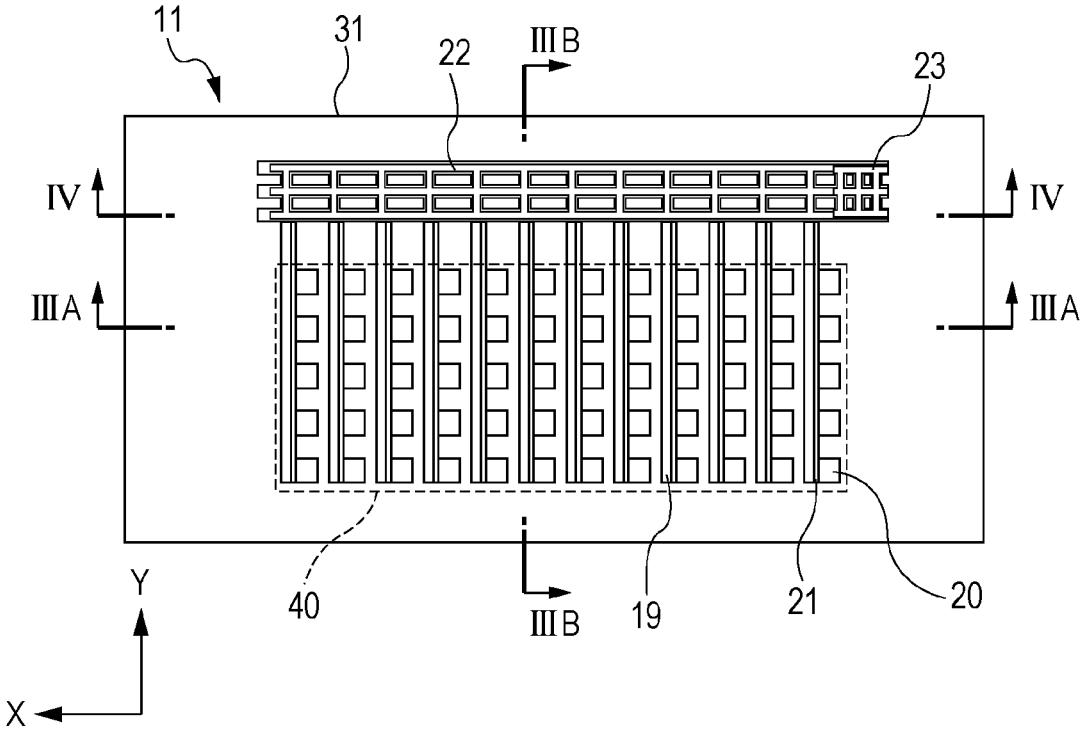
FIG. 2A is a plan view illustrating a face plate according to the present invention.
Figure 2B:
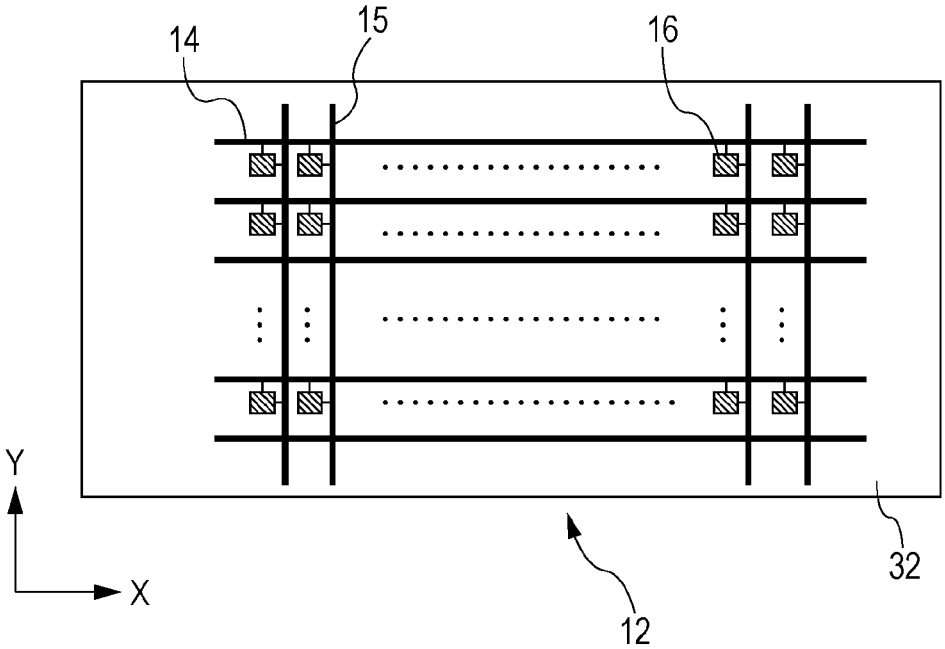
FIG. 2B is a plan view illustrating a rear plate according to the present invention.
Figure 3A:
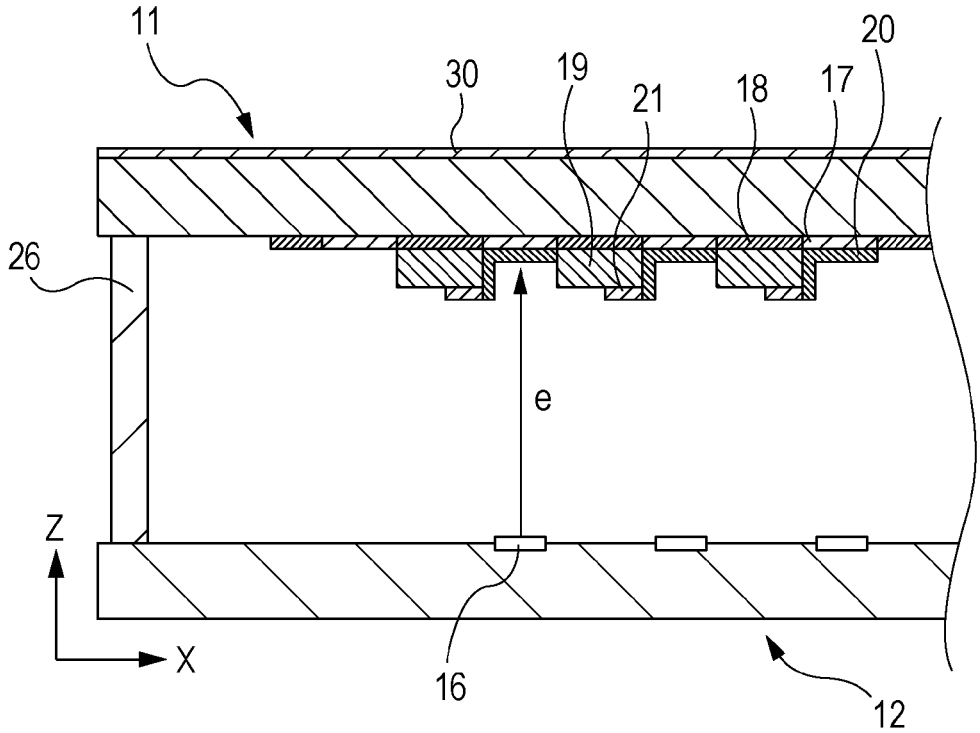
FIG. 3A is a partial sectional view of an image display apparatus including the face plate in FIG. 2A.
Figure 3B:
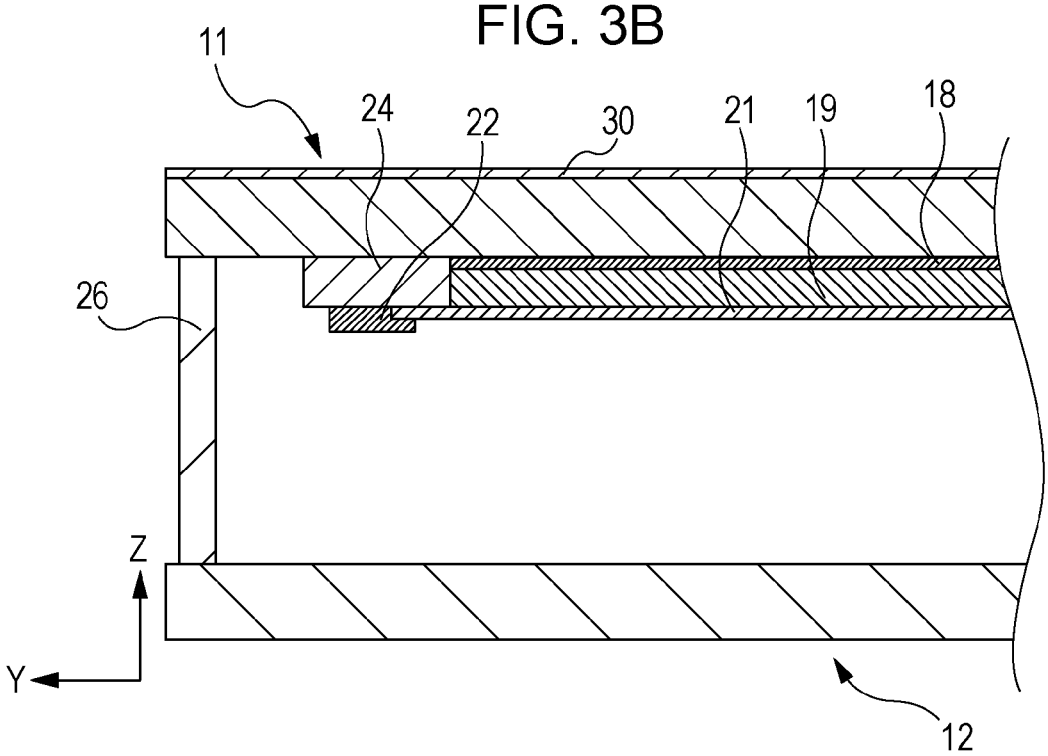
FIG. 3B is a partial sectional view of an image display apparatus including the face plate in FIG. 2A.
Figure 4:
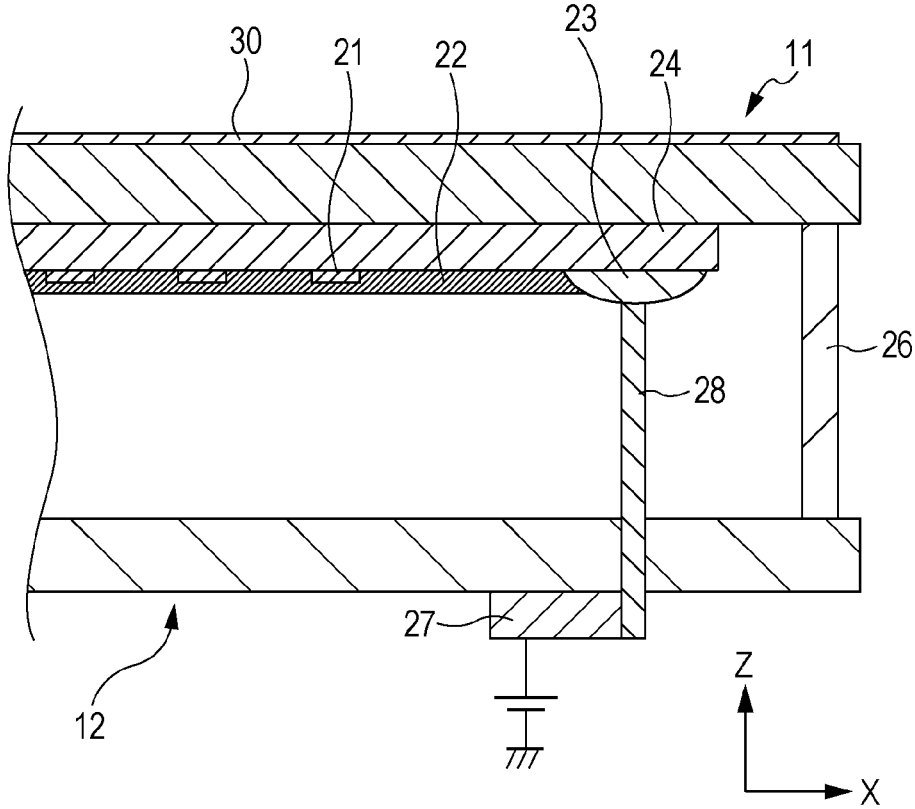
FIG. 4 is another partial sectional view of the image display apparatus including the face plate in FIG. 2A.

Hereinafter, embodiments of the present invention will be described in detail with reference to the drawings. FIG. 1 is a perspective view illustrating the general configuration of an image display apparatus 100 according to an embodiment. In the perspective view, a portion of the image display apparatus is cut away for illustrating the internal configuration of the apparatus. FIG. 2A illustrates a face plate 11 serving as a luminescent screen constituting the image display apparatus 100, the face plate 11 being viewed from a rear plate 12 side. FIG. 2B illustrates the rear plate 12 being viewed from the face plate 11 side, the face plate 11 serving as the luminescent screen. FIG. 3A is a sectional view taken along line IIIA-IIIA in FIG. 1. FIG. 3B is a sectional view taken along line IIIB-IIIB in FIG. 1. FIG. 4 is a sectional view taken along line IV-IV in FIG. 1. Note that, to clearly show the positional relationship between the line IIIA-IIIA, line IIIB-IIIB, and line IV-IV and the face plate serving as the luminescent screen in FIG. 1, the line IIIA-IIIA, line IIIB-IIIB, and line IV-IV are also illustrated in FIG. 2A. Note that, hereafter, the face plate serving as the luminescent screen is simply described as the face plate.

The rear plate 12 includes electron-emitting devices 16 on a back substrate 32. In the present embodiment, as illustrated in FIGS. 2B and 1, the plurality of electron-emitting devices 16 are included on the substrate and the plurality of electron-emitting devices 16 are connected in matrix with scanning wiring lines 14 and information wiring lines 15.

As illustrated in FIG. 2A, the face plate 11 includes, on a front substrate 31, a plurality of anode electrodes 20, partition wall members 19 positioned between the anode electrodes, and resistance members 21 that are positioned on the partition wall members 19 and electrically connect the anode electrodes adjacent to each other. A feeding electrode 22 being in contact with the resistance members is provided in a portion between the peripheral portion of the front substrate 31 and the region where the anode electrodes are formed. In an end portion of the feeding electrode, a connection part 23 connected to a terminal of a power supply circuit described below is provided. Light-emitting members 17 and a mesh-shaped base 24 are further provided on the front substrate 31, the light-emitting members 17 and the mesh-shaped base 24 being under other members and not shown in FIG. 2A. Hereinafter, the positional relationship between these members will be described. As illustrated in FIG. 3A, the plurality of light-emitting members 17 that emit light upon irradiation with electrons emitted from the electron-emitting devices 16 and the plurality of anode electrodes 20 positioned so as to overlap the light-emitting members 17 are provided on the front substrate 31. The partition wall members 19 projecting with respect to a surface of the front substrate 31 toward the rear plate 12 are provided between the light-emitting members adjacent to each other. As illustrated in FIGS. 3B and 2A, the resistance members 21 electrically connecting the anode electrodes 20 adjacent to each other in the Y direction are disposed on portions of the partition wall members 19 facing the rear plate 12. As illustrated in FIG. 4, a power supply circuit 27 for supplying a potential to the luminescent screen is provided on the outside of the image display apparatus 100. The power supply circuit 27 supplies a potential to the anode electrodes 20 via the resistance members 21. Note that, when the resistance members 21 and the power supply circuit 27 are disposed so as to be separated from each other at a distance, a voltage drop occurs in accordance with the distance. For this reason, the stripe-shaped resistance members 21 and the power supply circuit 27 are electrically connected to each other via the feeding electrode 22. In this way, by disposing the resistance members 21 on portions of the partition wall members 19 positioned between the light-emitting members 17 adjacent to each other, the portions facing the rear plate 12, the resistance members 21 do not block light emitted from the light-emitting members 17 and hence the light can be efficiently used. Accordingly, the brightness of the image display apparatus can be enhanced. Furthermore, since the resistance members 21 connected to the anode electrodes 20 are positioned on portions of the partition wall members 19, the portions facing the rear plate 12, portions between the anode electrodes 20 adjacent to each other in the X direction have high resistance. As a result, the withstand voltage of the portions between the anode electrodes 20 adjacent to each other in the X direction is increased.

In this way, by disposing the resistance members 21, which connect the anode electrodes 20 adjacent to each other, on the partition wall members 19, various advantages are provided.

However, when the resistance members 21 are disposed on the partition wall members 19 and the feeding electrode 22 connecting the resistance members 21 to the power supply circuit is disposed on a surface of the front substrate 31, to connect the resistance members 21 to the feeding electrode 22, portions straddling over stepped portions between the upper surfaces of the partition wall members and the surface of the front substrate 31 are generated. Thus, there are cases where breaking occurs in the straddling portions. As a result, a problem is caused in that feeding to the anode electrodes 20 connected to the resistance members 21 is not performed with stability.

Figure 10A:
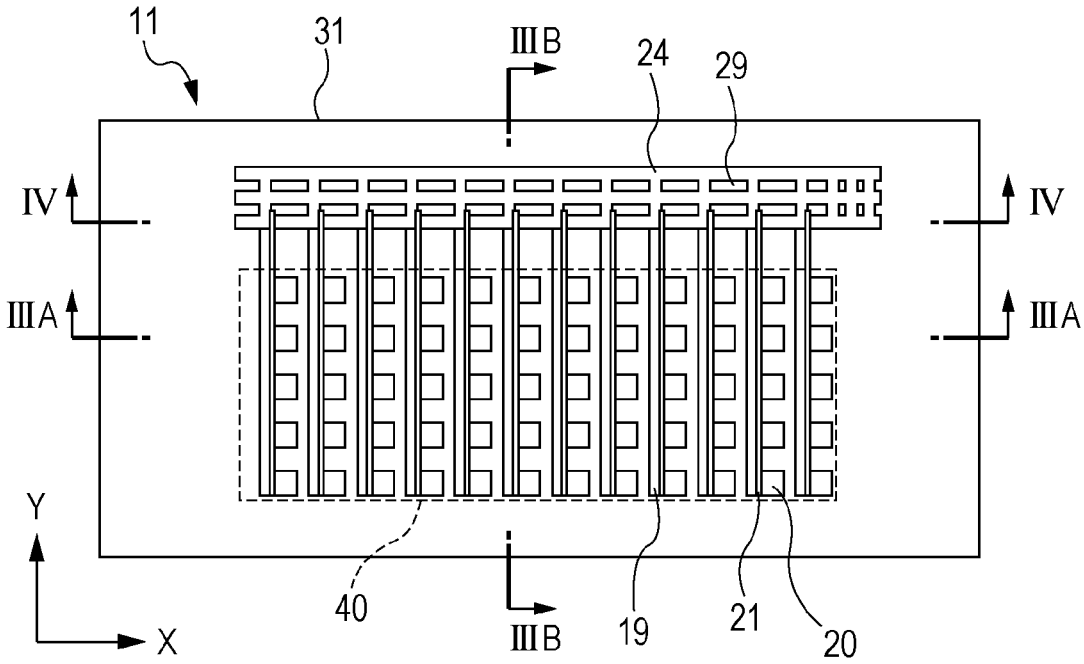
FIG. 10A illustrates the state in which a member of the face plate in FIG. 2A has been removed.

Accordingly, in the configuration of the present embodiment, as illustrated in FIGS. 2A, 3A, and 10A, the resistance members 21 positioned on the partition wall members 19 and the feeding electrode 22 that suppresses a voltage drop between the resistance members 21 and the power supply circuit 27 are disposed on the mesh-shaped base 24 disposed adjacent to the partition wall members 19. Here, FIG. 10A illustrates the state in which the feeding electrode 22 is removed from the configuration in FIG. 2A. The connection between the feeding electrode 22 and the resistance members 21 and the connection between the feeding electrode 22 and a terminal of the power supply circuit 27 are achieved on the mesh-shaped base 24 without straddling over stepped portions. Specifically, the feeding electrode 22 and the resistance members 21, and the feeding electrode 22 and a terminal of the power supply circuit 27, are brought into contact with each other on the mesh-shaped base 24 without straddling over stepped portions. As a result, since electrical paths from the resistance members 21 to the power supply circuit 27 do not have stepped portions in which disconnection is caused by straddling over stepped portions, a potential can be stably supplied to the anode electrodes 20 connected to the resistance members 21. Anode currents based on electrons having entered the anode electrodes 20 are joined into the feeding electrode 22, a large current passes through the feeding electrode 22. As a result, heat is generated in feeding electrode portions. However, as illustrated in FIG. 10A, by making the base 24 on which the feeding electrode is disposed have a mesh shape, a stress generated in the feeding electrode portions by heat generation can be reduced. Thus, damaging of the feeding electrode based on separation of the feeding electrode from the base, separation of the base from the front substrate, or the like can be suppressed and stable supply of anode voltage can be achieved. In addition, as illustrated in FIG. 1, there are cases where an antistatic film 30 composed of a transparent electrical conductive material such as ITO is formed on a counter surface of the face plate (the surface not facing the electron sources and being exposed to the air) for the purpose of suppressing electrification of the face plate. In general, compared with anode electrodes, a low voltage (for example, GND) is applied to the antistatic film 30. In this case, a voltage between the feeding electrode 22 and the antistatic film 30 generates a capacitance in feeding electrode portions. However, by making the base 24 have a mesh shape, this capacitance can be reduced. As a result, power consumption can be reduced.

Note that, the connection part 23 illustrated in FIG. 4 is a part where the feeding electrode 22 is in contact with the power supply circuit. A high-voltage pin 28 is a rod-shaped terminal part of the power supply circuit. The high-voltage pin 28 extends an output voltage of the power supply circuit 27 disposed on the outside of the image display apparatus 100 to the face plate 11.

Hereinafter, component members in the present embodiment will be described in detail.

As for the front substrate 31, a member through which visible light passes, such as glass, can be used. In the present embodiment, high-strain-point glass such as PD200 is preferably used.

As for the anode electrodes 20, a known metal back for CRTs or the like, the metal back being formed of Al or the like, can be used. To perform patterning for the anode electrodes 20, a vapor deposition method performed through a mask, an etching method, or the like can be used. As for the thickness of the anode electrodes 20, since electrons need to reach the light-emitting members 17 through the anode electrodes 20, the thickness is appropriately determined in consideration of energy loss of electrons, acceleration voltage (anode voltage) being set, and the reflecting efficiency of light. When a voltage of 5 kV to 15 kV is applied to the anode electrodes 20, the anode electrodes 20 are made to have a thickness of 50 [nm] to 300 [nm]. Note that, when transparent electrodes composed of ITO or the like as the anode electrodes 20, the configuration employed is not restricted to that illustrated in FIGS. 1 and 2A in which the anode electrodes 20 are positioned so as to overlap and cover the light-emitting members 17. The anode electrodes 20 may be disposed between the front substrate 31 and the light-emitting members 17.

As for the light-emitting members 17, fluorescent crystals that emit light due to excitation by electron beams can be used. As for specific fluorescent materials, for example, fluorescent materials that are described in "Phosphor Handbook" edited by Phosphor Research Society The Electrochemical Society of Japan (published by Ohmsha, Ltd.) and have been used for existing CRTs or the like can be used. The thickness of a fluorescent material is appropriately determined in accordance with acceleration voltage, the particle diameter of the fluorescent material, the filling density of the fluorescent material, or the like. When an acceleration voltage applied to the anode electrodes 20 is about 5 kV to 15 kV, a fluorescent material is made to have a thickness of 4.5 [μm] to 30 [μm], which is 1.5 to 3 times 3 [μm] to 10 [μm] (the average diameter of general fluorescent particles), preferably about 5 [μm] to 15 [μm].

Figure 5:
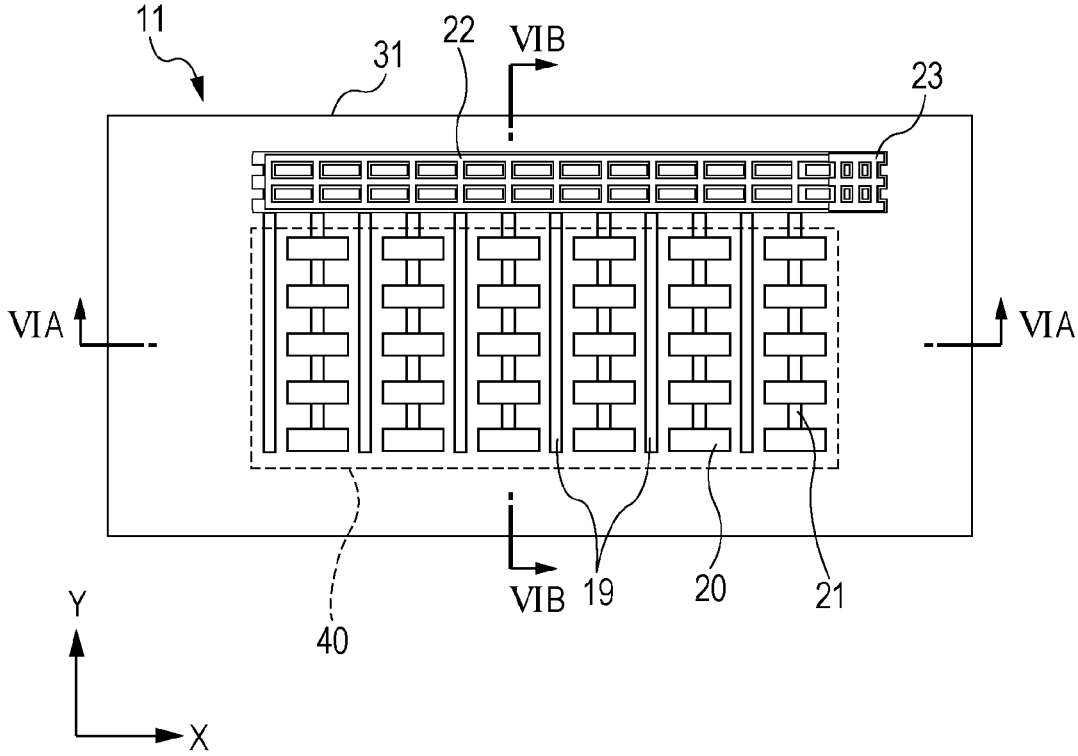
FIG. 5 illustrates another face plate according to the present invention.
Figure 7A:
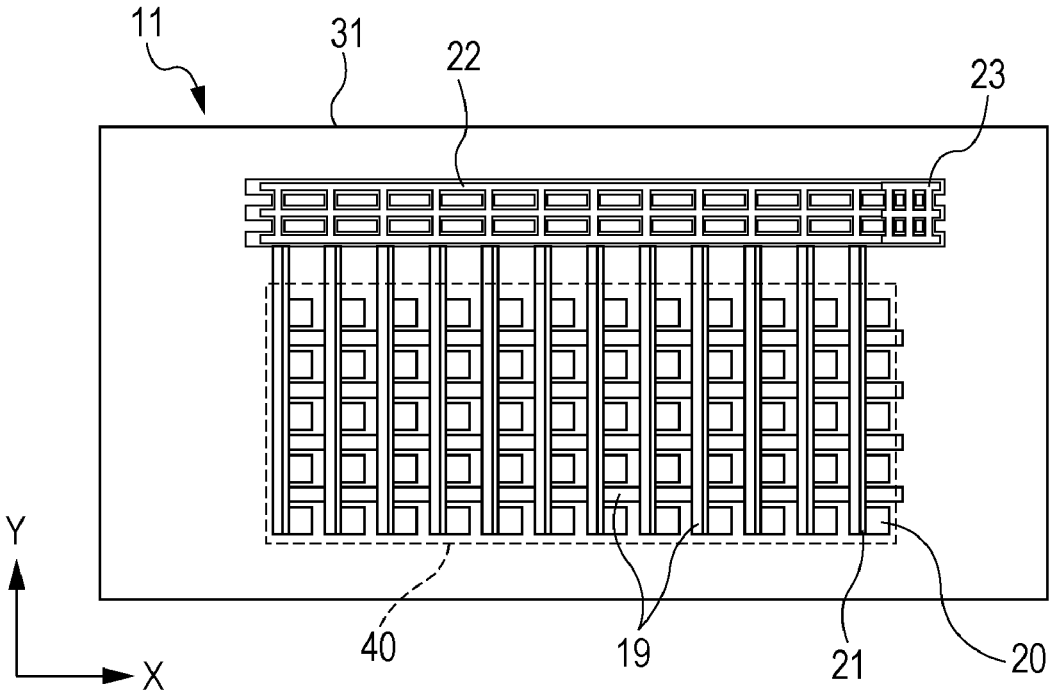
FIG. 7A is a plan view of a face plate including partition wall members constituted by grid-shaped members.
Figure 7B:
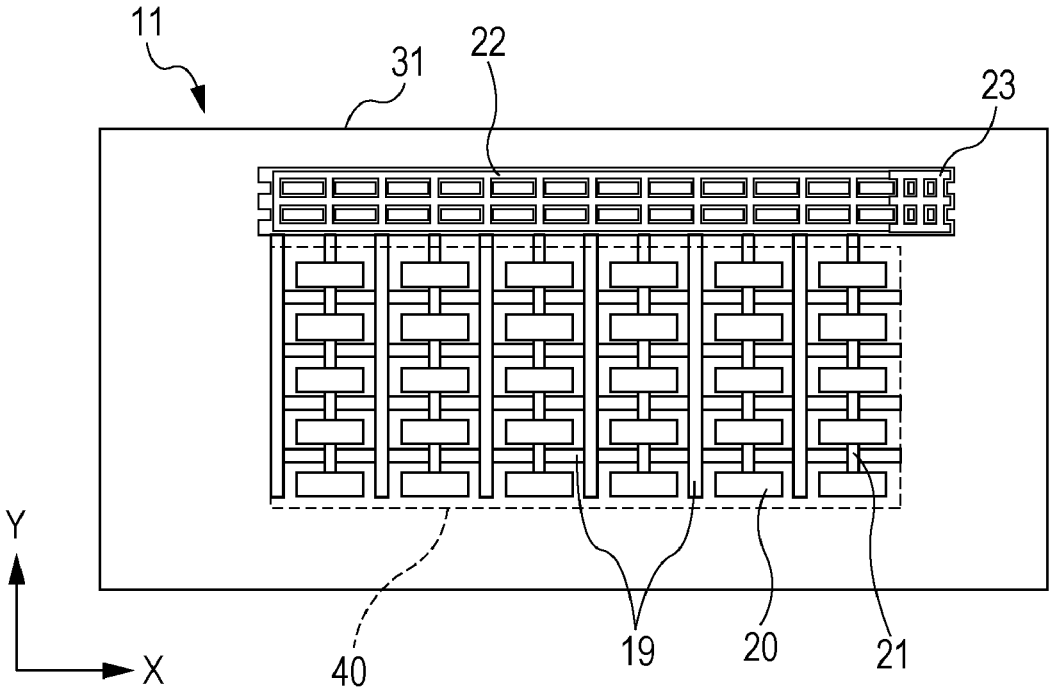
FIG. 7B is a plan view of a face plate including partition wall members constituted by grid-shaped members.

The partition wall members 19 are preferably formed of a material composed of an inorganic mixture having a resistance nearly exhibiting insulation, such as a glass material containing a metal oxide such as lead oxide, zinc oxide, bismuth oxide, boron oxide, aluminum oxide, silicon oxide, or titanium oxide. To perform patterning for the partition wall members 19, a method such as a sandblasting method, a photosensitive photopaste method, or an etching method can be used. Note that, the height of the partition wall members 19 is appropriately determined in accordance with the specification of an image display apparatus. The partition wall members 19 are preferably made to have a height of ½ to 10 times the width (length in the x or y direction in figures) of the light-emitting members 17. For example, when a light-emitting member 17 has a width of 50 [μm], the partition wall members 19 are preferably made to have a height of 25 [μm] to 500 [μm]. As a result, the occurrence of the halation phenomenon in which electrons reflected by a light-emitting member 17 reach another light-emitting member 17 to cause light emission can be suppressed, which is preferable. The partition wall members 19 are not restricted to those constituted by a plurality of stripe-shaped members separated from each other as illustrated in FIG. 2A and may be constituted by grid-shaped members illustrated in FIGS. 7A and 7B. Note that, FIGS. 7A and 7B respectively illustrate face plates when the partition wall members 19 in FIGS. 2A and 5 are constituted by grid-shaped members. In such a case where the partition wall members 19 are constituted by grid-shaped members, the occurrence of the above-described halation phenomenon can be suppressed in two directions (X and Y directions), which is preferable. In summary, the invention of the subject application can be applied not only to a face plate including the partition wall members 19 constituted by a plurality of stripe-shaped members separated from each other as illustrated in FIG. 2A, but also to a face plate including the partition wall members 19 constituted by grid-shaped members as illustrated in FIGS. 7A and 7B.

As for the component members of the resistance members 21, a resistive material such as ruthenium oxide, titanium oxide, tin oxide, ITO, or ATO can be used. As for a method for forming the stripe-shaped resistance members 21, existing methods such as a printing method or a coating method with a dispenser can be used.

As for the resistance of the resistance members 21, a discharge current can be suppressed with a higher resistance. However, when the resistance is too high, a voltage drop is caused at the anodes by currents generated by electron beams. The optimal resistance of the resistance members 21 is preferably about 1 kΩ to 1 MΩ in consideration of the effect of suppressing a discharge current, withstand voltage characteristics between anode electrodes adjacent to each other, or the like.

The feeding electrode 22 is not particularly restricted as long as it is formed of an electrically conductive material such as metal. However, when a high voltage is applied from the power supply circuit 27 and the high-voltage pin 28 (a terminal of a high-voltage power supply circuit), to reduce a voltage drop in the feeding electrode 22 itself, the resistance between the connection part connected to the voltage pin 28 and a farthermost portion from the connection part is preferably made 1 [KΩ] or less. More preferably, this resistance is three or more orders smaller than (1/1000 or less) the resistance of the resistance members 21.

Figure 10B:
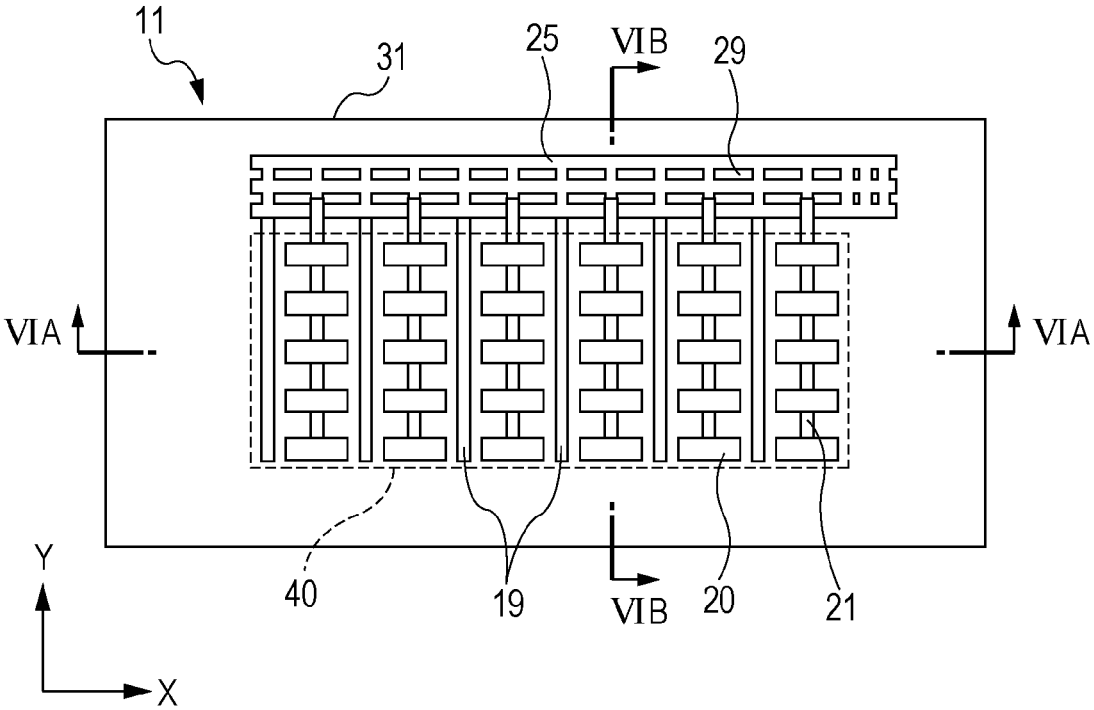
FIG. 10B illustrates the state in which a member of the face plate in FIG. 5 has been removed.
Figure 11A:
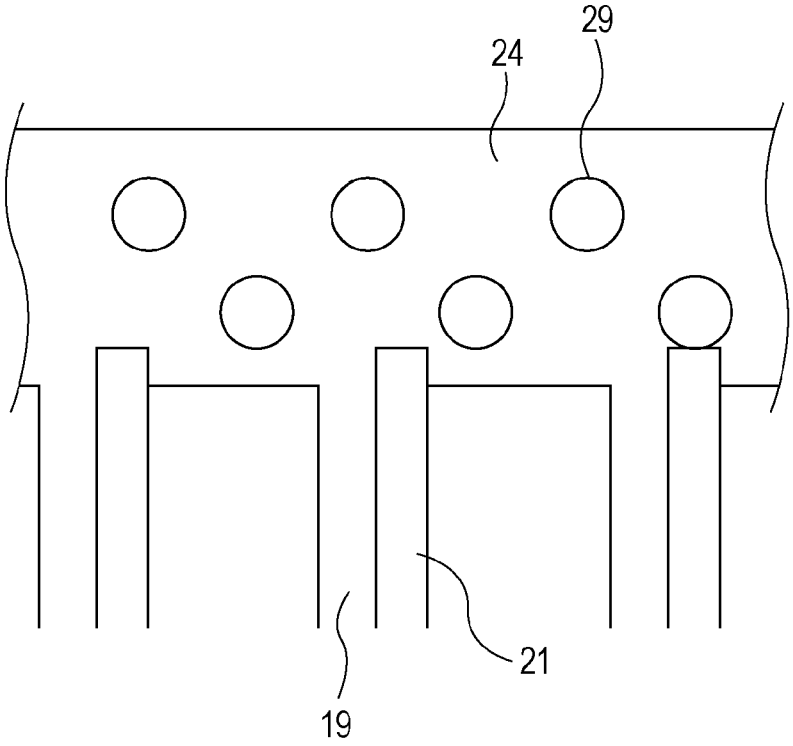
FIG. 11A is a partial enlarged view of a near-base portion.
Figure 11B:
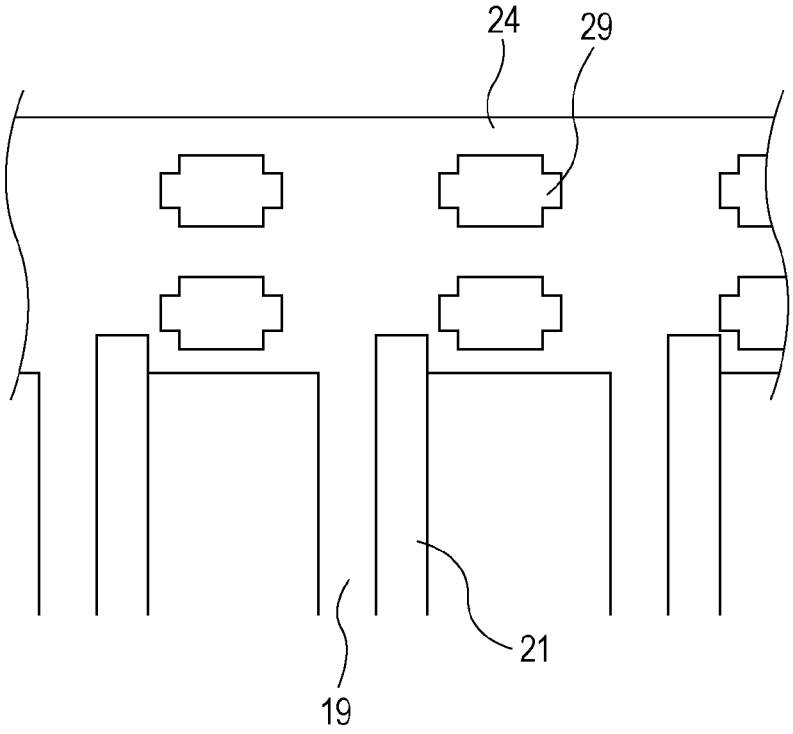
FIG. 11B is a partial enlarged view of a near-base portion.

As for the base 24, various members can be used as long as the base 24 can be formed by controlling the height of the base 24 such that disconnection caused between the feeding electrode 22 and the resistance members 21 positioned on the partition wall members 19 and caused due to the height difference between the partition wall members and a surface of the front substrate is not caused. For example, a material that releases a small amount of gas in a vacuum such as polyimide can be used. Alternatively, a ceramic containing alumina or zirconia, a material obtained by firing a paste containing a low-melting glass frit, or a material in which a metal oxide having a relatively low electrical conductivity such as ZnO or SnO contains a low-melting glass frit may also be used. The same material as in the partition wall members 19 can also be used. The base is preferably constituted by the partition wall members. The base is positioned outside a region where the light-emitting members are positioned, so as to be adjacent to the partition wall members 19. Note that the region where the light-emitting members are positioned is an inward portion with respect to the light-emitting members that are positioned in the outermost periphery. This region is a dotted region denoted by reference numeral 40 in FIG. 2A, that is, an image display region. The base 24 being adjacent to the partition wall members 19 means that the resistance members 21 straddling between the partition wall members 19 and the base 24 are positioned so as not to be hung toward the front substrate 31. As long as such a condition is satisfied, the base 24 may be positioned at a distance from the partition wall members 19. Note that the base 24 is preferably positioned so as to be in contact with the partition wall members 19. The shape of the base is formed so as to be a mesh shape such as a grid shape. Note that the mesh shape is a networked shape and examples thereof are illustrated in FIGS. 11A and 11B. FIGS. 11A and 11B are partial views in which near-base structures are enlarged. As illustrated in FIGS. 11A and 11B, a structure according to the present invention is not restricted to the above-described grid structure including quadrangle openings 29 illustrated in FIGS. 10A and 10B and encompasses, for example, structures including circular openings 29 and cross-shaped (cruciform) openings 29. Note that, as in FIGS. 10A and 10B, FIGS. 11A and 11B illustrate the state in which the feeding electrode 22 has been removed.

When the feeding electrode is covered with a resistive material, a discharge current generated between the feeding electrode and, for example, the electron-emitting devices can be suppressed, which is preferable. Note that, as for a resistive material with which the feeding electrode is covered, the resistance members 21 may be used. Specifically, the feeding electrode 22 is formed and the resistance members 21 are formed so as to cover the feeding electrode 22.

Note that, in the present embodiment, as illustrated in FIGS. 3A and 3B, a light-shielding member 18 is provided between the partition wall members 19 and the face plate 11 as a preferred embodiment.

As for the light-shielding member 18, the known black matrix structure for CRTs or the like can be employed. The light-shielding member 18 is generally formed of a black metal, a black metal oxide, carbon, or the like. Examples of such a black metal oxide include ruthenium oxide, chromium oxide, iron oxide, nickel oxide, molybdenum oxide, cobalt oxide, and copper oxide.

Next, the rear plate 12 will be described. As illustrated in FIGS. 1 and 2B, the plurality of electron-emitting devices 16 that emit electrons for causing the light-emitting members 17 to emit light by excitation are provided on the inner surface of the rear plate 12. As for the electron-emitting devices 16, for example, surface-conduction emitting devices are suitably used. The plurality of scanning wiring lines 14 and the plurality of information wiring lines 15 for supplying a driving voltage to the electron-emitting devices 16 are also provided on the inner surface of the rear plate 12.

A spacer 13 serving as an anti-atmospheric-pressure structure is preferably disposed between the rear plate 12 and the face plate 11. The spacer 13 is disposed in a portion between light-emitting members 17 adjacent to each other so that the spacer 13 does not influence images displayed by the image display apparatus.

The spacer 13 is constituted by an insulation material such as glass, a member in which an insulation material is mixed with an electrically conductive material, or the like. A configuration in which the surface is covered with a resistive material may also be used. In such a case where the spacer 13 is made to have a slight electrical conductivity (hereafter, referred to as a conductive spacer), electrification of the spacer can be suppressed, which is preferable. As a result, the trajectory of electrons emitted from the electron-emitting devices is stabilized and good images can be displayed.

The face plate 11, the rear plate 12, and the spacer 13 having been described above are prepared and the spacer 13 is placed between the face plate 11 and the rear plate 12. The peripheral portions of the face plate 11 and the rear plate 12 are bonded together through a side wall 26 to form the image display apparatus 100.

When an image is displayed with the thus-formed image display apparatus 100, a voltage is applied by the power supply circuit 27 through the feeding electrode 22 and the resistance members 21 to the anode electrodes 20. At this time, voltages are applied through terminals Dy and Dx to the scanning wiring lines 14 and the information wiring lines 15 to supply driving voltages to electron-emitting devices 16, causing the desired electron-emitting devices 16 to emit electron beams. The electron beams emitted from the electron-emitting devices are accelerated and impinge on light-emitting members 17. As a result, the light-emitting members 17 are selectively excited to emit light. Thus, an image is displayed.

EXAMPLES

Example 1

Hereinafter, a first example according to the present invention will be described. Note that, since the rear plate and the general configuration of the image display apparatus are described in the above-described embodiment, only features of EXAMPLE 1 will be described. FIG. 2A illustrates the face plate 11 of EXAMPLE 1, the face plate 11 being viewed from the rear plate side. FIGS. 3A, 3B, and 4 respectively illustrate sections taken along IIIA-IIIA, IIIB-IIIB, and IV-IV in FIG. 1 (or FIG. 2A).

(Step 1: Formation of Black Matrix)

A black paste was printed on a surface of the front substrate 31 (PD200) that was a glass on a surface (back surface) of which the antistatic film 30 composed of ITO was provided. The printed paste was exposed and developed by a photolithographic technique to be patterned into a grid shape. Thus, the light-shielding member 18 serving as the black matrix was formed. The pitches of openings were made 630 [μm] in the Y direction and 210 [μm] in the X direction as in the electron-emitting devices, which faced the openings. The sizes of the openings were made 295 [μm] in the Y direction and 145 [μm] in the X direction.

(Step 2: Application of Partition Wall Material and Base Material)

Next, to form stripe-shaped partition wall members extending in the Y direction on the light-shielding member 18, a bismuth-oxide insulation paste was applied with a slit coater such that the film thickness after firing would become 190 μm. The applied paste was dried at 120° C. for 10 minutes to form preforms of the partition wall members. A zinc-oxide insulation paste was applied with a slit coater in a region where the feeding electrode 22 would be formed in a later step such that the applied paste was adjacent to the preforms of the partition wall members and the film thickness after firing would become 190 μm. The applied paste was dried at 120° C. for 10 minutes to from a preform of a base.

(Step 3: Formation of Partition Wall Members and Base)

Next, a dry film resist (DFR) was affixed to the preforms of the partition wall members and the preform of the base with a laminating apparatus. A chromium mask for exposing the DFR was then aligned to a predetermined position and the DFR was exposed in a pattern. The chromium mask used had a shape on the preforms of the partition wall members, the shape masking stripe-shaped portions (unexposed portions) overlapping the light-shielding member 18, having a width of 50 μm in the X direction, and extending in the Y direction; and had a shape on the preform of the base, the shape masking mesh-shaped portions (grid portions in which portions having a width of 50 μm extend both in the X direction and the Y direction) extending in the X direction. The DFR was then exposed through this chromium mask. Furthermore, the DFR was subjected to a developing (removing exposed portions) treatment with a developer, a showering treatment by rinsing, and a drying treatment to form a mask for sandblasting, the mask having openings at desired portions and being constituted by the DFR. A sandblasting method using SUS particles as abrasive grains was performed. Thus, the preforms of the partition wall members and the preform of the base were patterned in accordance with the openings of the DFR such that unnecessary portions of the preforms were removed, the preforms of the partition wall members were patterned into stripe shapes extending in the Y direction, and the preform of the base was patterned into a mesh shape extending in the X direction (in EXAMPLE 1, a grid shape). After that, the DFR was stripped by being showered with a stripping solution and the substrate was washed.

(Step 4: Formation of Resistance Members)

A high-resistance paste containing ruthenium oxide was formed with a dispenser such that the film thickness after firing would become 5 μm on the thus-patterned preforms of the partition wall members and from the preforms of the partition wall members to the mesh-shaped preform of the base. The formed paste was dried at 120° C. for 10 minutes. Note that the material used for forming the high-resistance layer was applied in a test pattern and the resistance of the applied paste was measured. The volume resistivity was found to be $10^{-1}\Omega\cdot m$.

(Step 5: Firing)

These were fired at 530° C. to form the partition wall members 19 constituted by a plurality of stripe-shaped members extending in the Y direction, the stripe-shaped resistance members 21 positioned on the partition wall members and from the partition wall members to the mesh-shaped base 24, and the mesh-shaped base 24 extending in the X direction.

(Step 6: Application of Fluorescent Material)

Next, as for the light-emitting members 17, a paste in which P22 fluorescent material used in the field of CRTs was dispersed was used. The fluorescent material was drop-in printed by a screen printing method so as to be aligned with the partition wall members 19 having the stripe-shaped openings. In EXAMPLE 1, to provide a color display, fluorescent materials having three colors R, G, and B were individually applied in a stripe pattern. The film thickness of each fluorescent material was made 15 μm. After that, the fluorescent materials having three colors were subjected to a drying treatment at 120° C. Note that, the drying treatment may be performed separately for each color or together for the three colors. Furthermore, an aqueous solution containing alkaline silicate that would function as a binding material, that is, water glass, was applied on the fluorescent materials by spraying.

(Step 7: Formation of Metal Back)

Next, an acrylic emulsion was applied by a spray-coating method and dried to fill interspaces in the fluorescent powder materials with an acrylic resin. After that, an aluminum film that would serve as the anode electrodes 20 was deposited on the fluorescent materials. At this time, the anode electrodes 20 were formed using a metal mask having openings only in portions corresponding to the fluorescent materials serving as the light-emitting members 17 and portions of the stripe-shaped resistance members 21. Note that the aluminum film serving as the anode electrodes 20 was made to have a thickness of 90 nm.

Note that the anode electrodes 20 are not restricted to aluminum, and titanium, chromium, or the like may be used.

(Step 8: Formation of Feeding Electrode)

Next, the feeding electrode 22 was formed on the mesh-shaped base 24 such that portions of the feeding electrode 22 overlap the resistance members 21. Specifically, the feeding electrode 22 was formed by printing a glass paste in which silver particles were dispersed on the mesh-shaped base 24 using a printing screen having openings (in EXAMPLE 1, openings having shapes equivalent to the mesh-shaped base 24) corresponding to the pattern of the feeding electrode 22. At the same time, the connection part 23 connected to the high-voltage pin 28 of the power supply circuit 27 was also formed on the mesh-shaped base 24. The feeding electrode 22 and the connection part 23 were dried at 120° C. and subsequently fired at 500° C.

(Step 9: Formation of Rear Plate and Spacer)

The rear plate 12 was formed by forming, on the glass member (PD200: back substrate 32), the surface-conduction emitting devices 16 serving as the plurality of electron-emitting devices described in the embodiment, the plurality of scanning wiring lines 14, and the plurality of information wiring lines 15 were formed. A hole through which the high-voltage pin 28 serving as a terminal of the power supply circuit extended was formed in a portion of the back substrate 32, the portion facing the connection part 23 of the face plate 11. The power supply circuit 27 was disposed near the hole in the back surface (surface not facing the face plate 11) of the back substrate 32. The spacer 13 was constituted by a glass member (PD200).

The image display apparatus 100 illustrated in FIG. 1 was produced with the thus-produced face plate 11, rear plate 12, and spacer 13. Note that, in the formation of the image display apparatus 100, alignment was sufficiently performed such that the high-voltage pin 28 of the power supply circuit 27 was brought into contact with the connection part 23 of the feeding electrode 22 positioned on the mesh-shaped base. Sectional views taken along line IIIA-IIIA, line IIIB-IIIB, and line IV-IV in FIG. 1 are respectively illustrated in FIGS. 3A, 3B, and 4.

In the thus-formed image display apparatus 100, a voltage of 8 kV was applied by the power supply circuit 27 through the feeding electrode 22 and the stripe-shaped resistance members 21 to the anode electrodes 20 to display images. As illustrated in FIGS. 3A, 3B, and 4, by disposing the partition wall members 19 and placing the stripe-shaped resistance members 21 on the partition wall members 19, sufficiently high light-emitting brightness was obtained and good images having less color mixture caused by halation were displayed. Stepped breakages did not occur in contact portions between the stripe-shaped resistance members 21 and the feeding electrode 22. Damages (breakage or separation) of feeding electrode portions by heat generated in the feeding electrode portions also did not occur. No problems occurred during image displaying for a long period of time.

Note that, in EXAMPLE 1, the stripe-shaped resistance members 21 were formed so as to be positioned from the partition wall members 19 to the mesh-shaped base 24. However, this is not limitative. The feeding electrode 22 may be formed so as to be positioned from the base 24 to the partition wall members 19 and be in contact with the resistance members 21 on the partition wall members 19.

Example 2

Figure 6A:
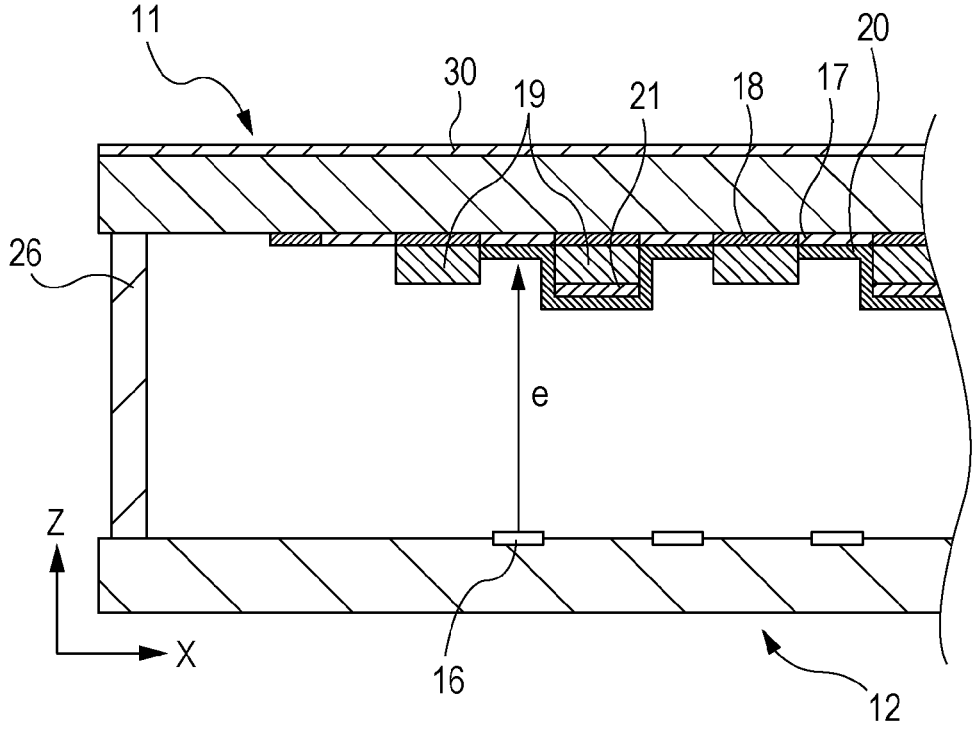
FIG. 6A is a partial sectional view of an image display apparatus including the face plate in FIG. 5.
Figure 6B:
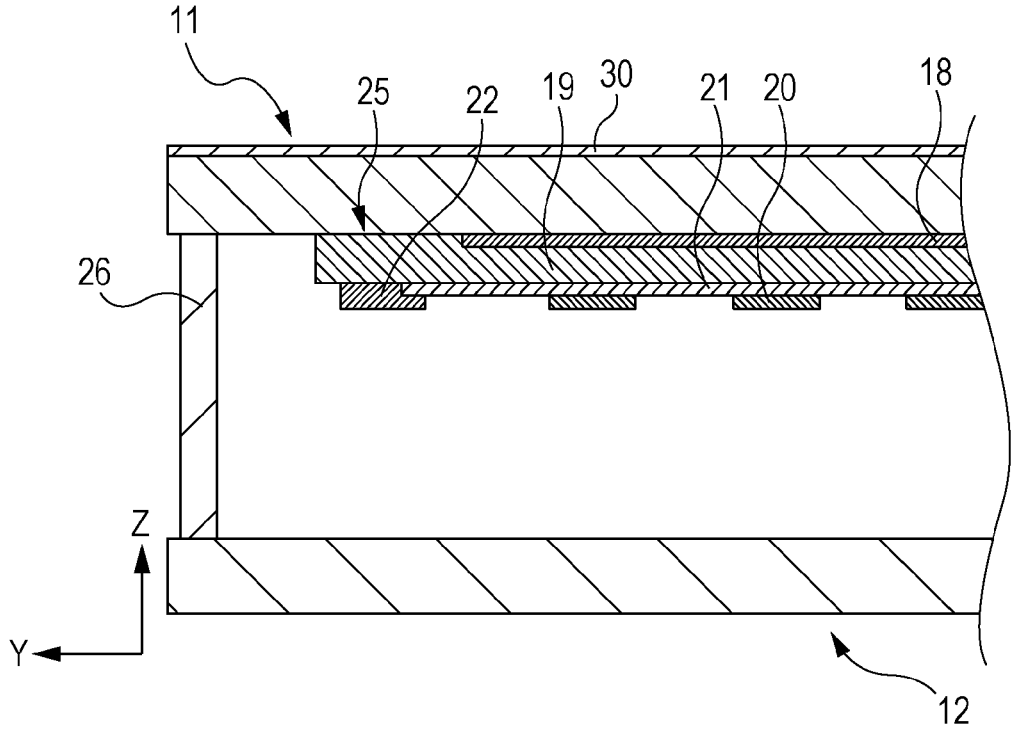
FIG. 6B is a partial sectional view of an image display apparatus including the face plate in FIG. 5.

Hereinafter, a second example according to the present invention will be described. The basic configuration is the same as in EXAMPLE 1. EXAMPLE 2 is different from EXAMPLE 1 in that a face plate having the configuration illustrated in FIGS. 5, 6A, and 6B was used. Note that the configuration in which the feeding electrode 22 in FIG. 5 has been removed is illustrated in FIG. 10B. The feature of the configuration of EXAMPLE 2 is that, as illustrated as a base portion 25 in FIG. 10B, the partition wall members 19 were formed so as to extend to an area outside the region where the light-emitting members 17 were positioned on the front substrate 31 and such extension portions (base portions 25) were formed so as to have a mesh shape. Stated another way, the partition wall members 19 were formed so as to extend to the position of the mesh-shaped base 24 in EXAMPLE 1 and such extension portions (base portions 25) of the partition wall members 19 were formed so as to have a mesh shape. Note that the region where the light-emitting members were positioned was an inward portion with respect to the light-emitting members that were positioned in the outermost periphery. This region was a dotted region denoted by reference numeral 40 in FIG. 5, that is, an image display region. What was different from EXAMPLE 1 was that the feeding electrode 22 was provided on the mesh-shaped portions (the base portions) of the partition wall members, the portions being positioned outside the image display region (the region where the light-emitting members were positioned), and the feeding electrode 22 was brought into contact with, on the mesh-shaped partition wall members (on the base portions), the resistance members 21 and the high-voltage pin 28 serving as a terminal of the power supply circuit 27. What was also different from EXAMPLE 1 was that the anode electrodes 20 covered two light-emitting members adjacent to each other in the X direction and the anode electrodes 20 individually covered the resistance members 21. Note that, FIG. 6A is a sectional view taken along VIA-VIA in FIG. 5; and FIG. 6B is a sectional view taken along VIB-VIB in FIG. 5.

In the image display apparatus 100 of EXAMPLE 2, a voltage of 8 kV was applied by the power supply circuit 27 through the feeding electrode 22 and the stripe-shaped resistance members 21 to the anode electrodes 20 to display images. As a result, as in EXAMPLE 1, sufficiently high light-emitting brightness was obtained and good images having less color mixture caused by halation were displayed. Stepped breakages did not occur in contact portions between the stripe-shaped resistance members 21 and the feeding electrode 22. Damages (breakage or separation) of feeding electrode portions by heat generated in the feeding electrode portions also did not occur. No problems occurred during image displaying for a long period of time. Furthermore, since connection portions of the stripe-shaped resistance members 21 to the anode electrodes 20 were covered with the anode electrodes 20, electrical connection between the anode electrodes 20 and the stripe-shaped resistance members 21 was established with more certainty. As a result, the potential of the anode electrodes 20 was stabilized and better images were displayed.

Example 3

Hereinafter, a third example according to the present invention will be described. The basic configuration is the same as in EXAMPLE 1. EXAMPLE 3 is different from EXAMPLE 1 in that a face plate having the configuration illustrated in FIGS. 8A, 8B, and 9 was used.

Figure 8A:
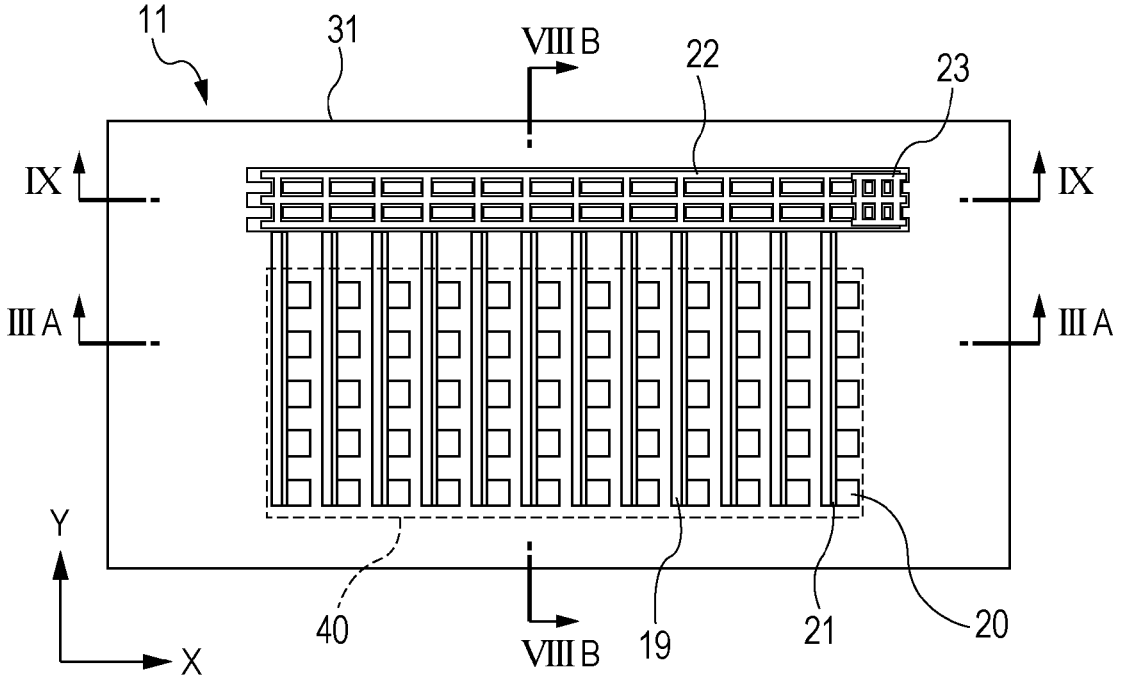
FIG. 8A illustrates another face plate according to the present invention.
Figure 8B:
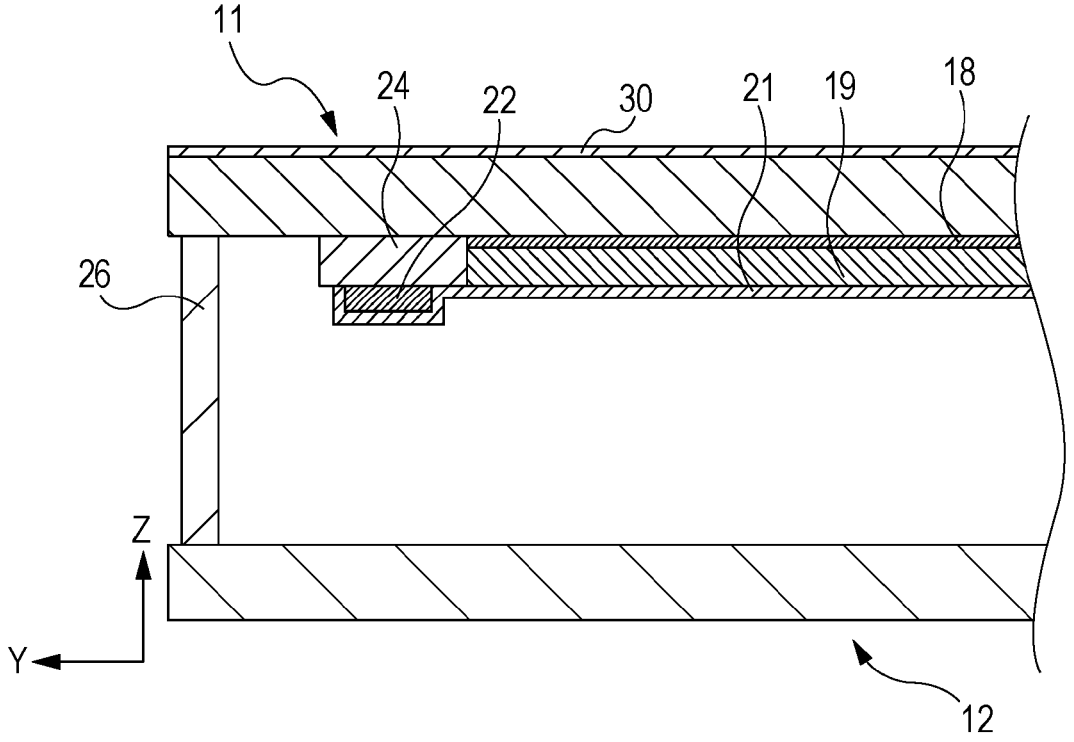
FIG. 8B provides a partial sectional view of an image display apparatus including the face plate illustrated in FIG. 8A.
Figure 9:
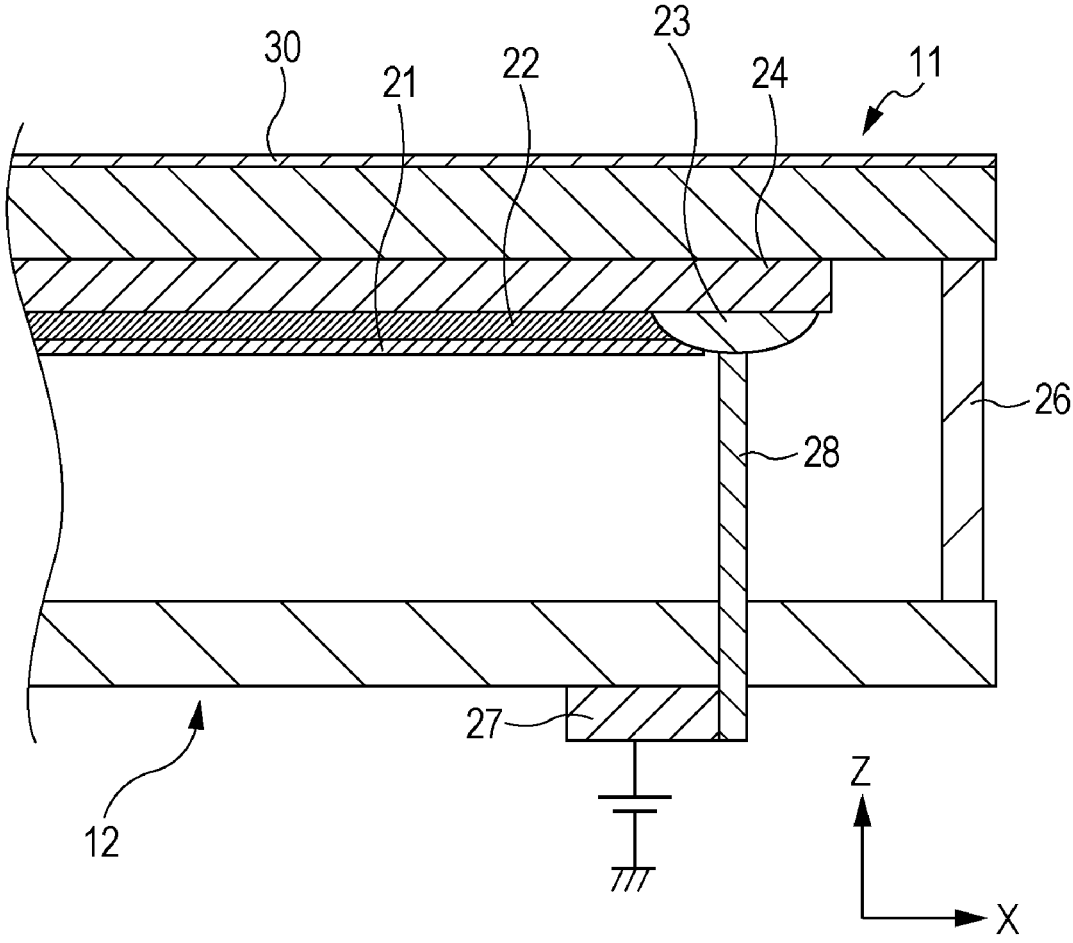
FIG. 9 is another partial sectional view of an image display apparatus including the face plate in FIG. 8A.

Specifically, EXAMPLE 3 is different from EXAMPLE 1 in that the feeding electrode 22 was formed before the formation of the resistance members 21 and the resistance members 21 were then formed so as to cover the feeding electrode 22. Note that FIG. 8A illustrates the face plate 11 being viewed from the rear plate 12 side. FIG. 8B is a sectional view taken along VIIIB-VIIIB in FIG. 8A. FIG. 9 is a sectional view taken along IX-IX in FIG. 8A. Note that a sectional view taken along IIIA-IIIA in FIG. 8A is similar to FIG. 3A. Hereinafter, steps of producing an image display apparatus of EXAMPLE 3 will be described. Descriptions of steps similar to those in EXAMPLE 1 are omitted.

(Step 1: formation of black matrix), (Step 2: application of partition wall material and base material), and (Step 3: formation of partition wall members and base) were the same as in EXAMPLE 1. However, (Step 4: formation of resistance members) was not performed and (Step 5: firing) was performed. Thus, the partition wall members 19 and the mesh-shaped base 24 were formed.

Next, (Step 6: application of fluorescent material) and (Step 7: formation of metal back) were performed as in EXAMPLE 1.

(Step 8: formation of feeding electrode) Next, the feeding electrode 22 was formed on the mesh-shaped base 24. Specifically, the feeding electrode 22 was formed by printing a glass paste in which silver particles were dispersed on the base 24 using a printing screen having openings corresponding to the pattern of the feeding electrode 22. At the same time, the connection part 23 connected to the high-voltage pin 28 serving as a terminal of the power supply circuit 27 was also formed on the base 24. The feeding electrode 22 and the connection part 23 were dried at 120° C.

(Step 9: formation of resistance members) A high-resistance paste containing ruthenium oxide was formed with a dispenser so as to cover the partition wall members 19 and the patterned feeding electrode 22 on the mesh-shaped base 24 and such that the film thickness after firing would become 5 μm. The formed paste was dried at 120° C. for 10 minutes and subsequently fired at 500° C.

After that, the procedures of Step 9 and thereafter (formation of rear plate and spacer and thereafter) in EXAMPLE 1 were performed to produce an image display apparatus.

In EXAMPLE 3, the same advantages as in EXAMPLE 1 were also achieved. In addition, since the feeding electrode 22 was covered with the resistance members 21 having high resistance, currents generated by discharging caused in feeding electrode portions (for example, discharging caused between the feeding electrode and the electron-emitting devices) were suppressed. As a result, an image display apparatus operating with stability compared with EXAMPLE 1 was obtained. Note that, the technique of EXAMPLE 3 may be combined with the above-described configuration of EXAMPLE 2 in which the partition wall members 19 including the base portions 25 are used instead of the formation of the base 24.

According to the present invention, a luminescent screen in which a potential can be stably supplied to anodes and an image display apparatus including such a luminescent screen can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image display apparatus comprising:

a rear plate including an electron-emitting device; and a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the feeding electrode is, on a mesh-shaped base adjacent to the partition wall member, in contact with the resistance member and a terminal of the power supply circuit.

2. The image display apparatus according to claim 1, wherein the feeding electrode is covered with the resistance member.

3. An image display apparatus comprising:

a rear plate including an electron-emitting device; and a luminescent screen including a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the partition wall member includes a mesh-shaped portion positioned outside a region where the plurality of light-emitting members are positioned on the substrate; and the feeding electrode is, on the mesh-shaped portion of the partition wall member, in contact with the resistance member and a terminal of the power supply circuit.

4. A luminescent screen comprising a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the feeding electrode is, on a mesh-shaped base adjacent to the partition wall member, in contact with the resistance member and includes a connection part on the mesh-shaped base, the connection part being connected to a terminal of the power supply circuit.

5. The luminescent screen according to claim 4, wherein the feeding electrode is covered with the resistance member.

6. A luminescent screen comprising a substrate and, on the substrate, a plurality of light-emitting members, a plurality of anode electrodes positioned so as to overlap the light-emitting members, a partition wall member positioned between the light-emitting members adjacent to each other and projecting from a surface of the substrate, a resistance member electrically connecting the anode electrodes adjacent to each other and being positioned on the partition wall member, and a feeding electrode electrically connecting the resistance member to a power supply circuit, wherein the partition wall member includes a mesh-shaped portion positioned outside a region where the plurality of light-emitting members are positioned on the substrate; and the feeding electrode is, on the mesh-shaped portion of the partition wall member, in contact with the resistance member and includes a connection part on the mesh-shaped portion, the connection part being connected to a terminal of the power supply circuit.

* * * * *